US009765437B2

(12) United States Patent
Herdman et al.

(10) Patent No.: US 9,765,437 B2
(45) Date of Patent: Sep. 19, 2017

(54) CHROMIUM ALLOY COATING WITH ENHANCED RESISTANCE TO CORROSION IN CALCIUM CHLORIDE ENVIRONMENTS

(76) Inventors: Roderick D. Herdman, Staffordshire (GB); Stacey Handy, West Midlands (GB); Trevor Pearson, West Midlands (GB); Toshiyuki Yamamoto, Chiba-Ken (JP); Kotaro Ishiwata, Tokyo (JP); Masahiro Hara, Kanagawa-Ken (JP); Tatsuya Nishiyama, Kanagawa-Ken (JP)

( * ) Notice: Subject to any disclaimer, the term of this patent is extended or adjusted under 35 U.S.C. 154(b) by 899 days.

(21) Appl. No.: 12/409,629

(22) Filed: Mar. 24, 2009

(65) Prior Publication Data

US 2010/0243463 A1 Sep. 30, 2010

(51) Int. Cl.

| | |
|---|---|
| ***C25D 3/06*** | (2006.01) |
| ***C25D 3/10*** | (2006.01) |
| ***C25D 5/10*** | (2006.01) |
| ***C25D 5/12*** | (2006.01) |
| ***C25D 5/34*** | (2006.01) |
| ***C23C 28/02*** | (2006.01) |
| ***C25D 5/14*** | (2006.01) |

(52) U.S. Cl.

CPC ..... *C25D 3/06* (2013.01); *C25D 3/10* (2013.01); *C25D 5/14* (2013.01)

(58) Field of Classification Search

CPC ... C25D 3/06; C25D 3/10; C25D 5/12; C25D 5/14; C25D 5/34

USPC ..... 205/170, 176, 181, 182, 187, 287, 288, 205/289, 290, 205

See application file for complete search history.

(56) References Cited

U.S. PATENT DOCUMENTS

| | | | | | |
|---|---|---|---|---|---|
| 1,963,391 | A | * | 6/1934 | Wirshing et al. | 205/180 |
| 3,681,210 | A | * | 8/1972 | Zievers et al. | 205/100 |
| 4,137,132 | A | * | 1/1979 | Ward et al. | 205/199 |
| 4,157,945 | A | * | 6/1979 | Ward et al. | 205/287 |
| 4,161,432 | A | * | 7/1979 | Barclay et al. | 205/288 |
| 4,374,007 | A | * | 2/1983 | Barclay et al. | 205/284 |
| 4,432,843 | A | | 2/1984 | Tremmel | 204/51 |
| 4,448,648 | A | | 5/1984 | Barclay et al. | 204/51 |
| 4,448,649 | A | | 5/1984 | Barclay et al. | 204/51 |
| 4,450,051 | A | | 5/1984 | Tremmel | 204/43 T |
| 4,472,250 | A | | 9/1984 | Barclay et al. | 204/51 |
| 4,473,448 | A | * | 9/1984 | Deeman | 205/287 |
| 4,502,927 | A | | 3/1985 | Barclay et al. | 204/51 |

(Continued)

FOREIGN PATENT DOCUMENTS

| | | | | |
|---|---|---|---|---|
| DE | 2550615 | A * | 5/1977 | C25D 3/06 |
| GB | 1 488 381 | | 10/1977 | |

(Continued)

*Primary Examiner* — Edna Wong

(74) *Attorney, Agent, or Firm* — Carmody Torrance Sandak & Hennessey

(57) ABSTRACT

The invention consists of a chromium electroplating solution comprising a chromium electroplating solution comprising: (1) a water soluble trivalent chromium salt; (2) at least one complexant for trivalent chromium ions; (3) a source of hydrogen ions sufficient to create a pH of from 2.8-4.2; (4) a pH buffering compound; and (5) a sulfur-containing organic compound. The chromium electroplating solution is usable in a method for producing an adherent metallic coating on a decorative article, such coating having enhanced resistance to corrosion in environments containing calcium chloride.

12 Claims, 1 Drawing Sheet

The Pourbaix Diagram for Chromium

(56) References Cited

U.S. PATENT DOCUMENTS

| | | | | |
|---|---|---|---|---|
| 4,543,167 | A * | 9/1985 | Seyb et al. | 205/287 |
| 4,563,399 | A * | 1/1986 | Wright, Jr. | 428/626 |
| 6,183,545 | B1 * | 2/2001 | Okuhama et al. | 106/1.18 |
| 6,468,672 | B1 | 10/2002 | Donovan, III et al. | 428/626 |
| 6,911,068 | B2 | 6/2005 | Cobley et al. | 106/1.25 |
| 2006/0065537 | A1 | 3/2006 | Barstad et al. | 205/291 |
| 2007/0227895 | A1 * | 10/2007 | Bishop et al. | 205/287 |
| 2008/0169199 | A1 * | 7/2008 | Huang et al. | 205/210 |

FOREIGN PATENT DOCUMENTS

| | | |
|---|---|---|
| GB | 2 171 114 | 8/1986 |
| JP | 57-152483 | 9/1982 |
| JP | 58-87290 | 5/1983 |
| JP | 58-87291 | 5/1983 |
| JP | 61-235592 | 10/1986 |

* cited by examiner

The Pourbaix Diagram for Chromium
$[Cr^{3+}]_{TOT}$= 10.00 μM
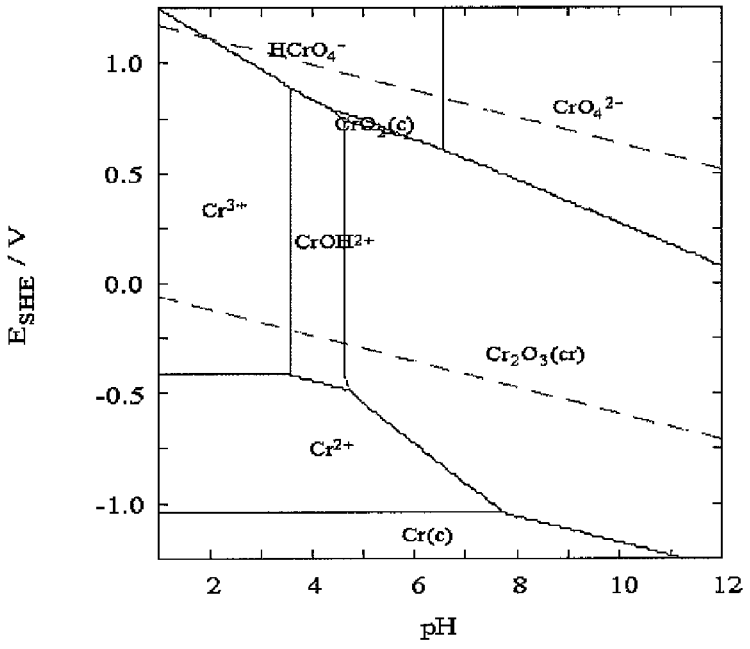
t= 25°C

CHROMIUM ALLOY COATING WITH ENHANCED RESISTANCE TO CORROSION IN CALCIUM CHLORIDE ENVIRONMENTS

FIELD OF THE INVENTION

The present invention relates generally to a method for covering an article with an adherent metallic chromium-based coating, preferably a decorative chromium coating. The chromium-based coating of the invention renders the article more corrosion resistant than traditional chromium deposits, especially in environments containing calcium chloride.

BACKGROUND OF THE INVENTION

Chromium has long had a presence in industrial coatings. The chemical and mechanical properties of chromium render it suitable for a number of applications including engineering applications and decorative applications. Engineering applications are generally defined as applications where the chromium layer is relatively thick (for example greater than 10 μm) whereas decorative applications normally have a thin layer of around 0.2-1.0 μm. In decorative applications the chromium deposit typically exhibits a specular metallic finish with a slight bluish tint.

The current invention, in one embodiment, is directed primarily to the application field of decorative coatings. The properties of chromium that make it suitable for these decorative applications include its attractive color and high hardness, which even with thin coatings provides for some scratch resistance.

The most cost-effective method of depositing substantial layers of chromium is electrodeposition which is traditionally used to deposit chromium from electrolytes containing hexavalent chromium compounds. Such electroplating baths have a poor efficiency and, as such, the building up of thick chromium coatings is not cost effective. Therefore, to provide resistance to the elements and corrosion protection for the base substrate one typical practice first applies a thick coating of nickel (normally between 10 and 50 μm) and then applies only a thin layer of chromium over the top of this nickel coating. The nickel coating may consist of a single layer or a combination of two, three or even four distinct layers to provide for maximum corrosion protection of the substrate material and to maintain the decorative appearance of the coating. Depending on the substrate material of the article, other pretreatment and metallic coatings layers may be applied prior to the nickel undercoat, for example in the case of parts manufactured from ABS or other non-conductive materials, or from zinc diecast materials. Such treatments are generally well known to those skilled in the art.

Typical commercial applications for these types of decorative coatings include shop fittings, sanitary fittings (such as taps, faucets and shower fixings) and automobile trim (such as bumpers, door handles, grilles and other decorative trim), by way of example and not limitation.

Traditionally the corrosion resistance of the aforementioned nickel/chromium deposits has been measured by a method known as the CASS test, applied according to the internationally recognized standard ASTM B368. This consists of exposing the electroplated articles to a corrosive fog spray (comprising aqueous sodium chloride, copper chloride and acetic acid) in an enclosed chamber at a temperature of 49° C. After a set exposure time the appearance of the articles is examined and the degree of their corrosion protection is assessed according to ASTM B537.

The degree of corrosion protection required depends upon the likely environment to be encountered by the electroplated article (for example exterior or interior automotive trim). The typical thicknesses and types of deposits recommended are summarized in the ASTM standards B456 and B604. Typically automotive companies will require parts for interior trim to be able to withstand 24 hours exposure to CASS, whereas exterior parts will typically require protection against exposure times of up to 72 hours.

Chloride-based environments are used for these corrosion tests as chloride is an aggressively corrosive ion and during the winter season it is normal practice to scatter sodium chloride on roads in order to facilitate the melting of ice and snow in order to make roads passable with a higher degree of safety. Thus the exposure of exterior automobile components to chloride ions can be very high.

In severe winter environments such as in northern Canada and Russia, sodium chloride is not sufficiently effective at snow melting and alternative salts have been used. Typical of these alternative salts are calcium chloride and magnesium chloride.

In the last few years, it has become apparent to the automotive industry that the use of calcium chloride represents a particular problem for chromium coatings. It is found that in environments where calcium chloride is used, salts can dry on the exterior of automobiles in combination with soils and mud. When this happens on a chromium coating, a particular type of accelerated corrosion occurs and the chromium deposit is effectively removed, leaving the nickel deposit exposed. This reduces the corrosion protection of the entire combination coating, and in addition, when the car is cleaned of these soils, the chromium deposit then looks unattractive as it exhibits dark spots, mottled appearance and yellow patches.

Thus automotive companies have a desire to improve the resistance of the chromium coatings to environments containing calcium chloride.

SUMMARY OF THE INVENTION

It is an object of the present invention to provide a chromium electroplating electrolyte capable of producing a thin corrosion resistant layer on a decorative article.

It is another object of the present invention to provide a chromium alloy coating on a decorative article that provides enhanced corrosion resistance, especially in environments containing calcium chloride.

It is still another object of the present invention to provide a chromium-sulfur alloy coating on a decorative article in accordance with the present invention.

In one embodiment, the present invention relates generally to an improved chromium electroplating bath comprising:

a. a water soluble trivalent chromium salt;
b. at least one complexant for trivalent chromium ions;
c. a source of hydrogen ions at a concentration sufficient to establish a pH of 2.8-4.2;
d. a pH buffering compound; and
e. a sulfur-containing organic compound.

In another embodiment, the present invention relates generally to a method of providing a corrosion resistant chromium alloy coating on an article to provide improved corrosion resistance thereon, the method comprising the steps of:

(a) Suitably cleaning and pretreating the article;
(b) Coating of the article by electrolytic or electroless means with one or more of the following; palladium, tin, copper, nickel, or other metal or alloy as desired and
(c) Coating the article with a deposit comprising a chromium-sulfur alloy as described herein to achieve an attractive and corrosion resistant finish on the article.

BRIEF DESCRIPTION OF THE DRAWINGS

For a fuller understanding of the invention, reference is made to the following description taken in connection with the accompanying FIGURE, in which:

FIG. 1 depicts the Pourbaix diagram for chromium.

DETAILED DESCRIPTION OF THE PREFERRED EMBODIMENTS

The present invention relates generally to an improved electroplating bath and method of providing a corrosion resistant chromium alloy coating on an article to provide improved corrosion resistance, especially in calcium chloride environments. In a preferred embodiment, the chromium alloy coating is a chromium-sulfur alloy coating.

The method generally comprises the following steps;
(a) Suitably cleaning and pretreating the article;
(b) Coating the article by electrolytic or electroless means with one or more of the following; palladium, tin, copper, nickel, or other metal as desired and
(c) Coating the article with a deposit comprising a chromium-sulfur alloy as described herein to achieve an attractive and corrosion resistant finish on the article.

The inventors of the present invention have found that chromium-sulfur coatings prepared in accordance with the present invention provide enhanced corrosion protection in calcium chloride environments as compared to traditional chromium coatings obtained from hexavalent chromium electroplating baths.

Without wishing to be bound by theory, the inventors propose that the hygroscopic nature of calcium chloride retains moisture in the dried soils. This moisture allows for the dissolution into the soils of atmospheric gases (primarily $CO_2$, but also $SO_x$ and $NO_x$) which creates an acidic environment due to the generation of hydrochloric acid by the following reaction schemes Equation 1 and Equation 2;

$$CaCl_2+2CO_2+2H_2O \rightarrow Ca(HCO_3)_2+2HCl \quad \text{Equation 1}$$

$$CaCl_2+CO_2+H_2O \rightarrow CaCO_3+2HCl \quad \text{Equation 2}$$

As seen in FIG. 1, which depicts the Pourbaix diagram for chromium, in environments of a neutral pH, chromium has a stable state of chromium (iii) oxide $Cr_2O_3$, but in mildly acidic environments with a pH below about 4.8, chromium will dissolve from the coating in the form of $Cr(OH)^{2+}$ according to Equation 3, and below about 3.6 will dissolve as $Cr^{3+}$ according to Equation 4.

$$2Cr+4H^{+}+1.5O_2 \rightarrow 2Cr(OH)^{2+}+H_2O \quad \text{Equation 3}$$

$$2Cr+6H^{+} \rightarrow 2Cr^{3+}+3H_2 \quad \text{Equation 4}$$

Automotive companies have a desire to improve the resistance of the chromium coatings to environments containing calcium chloride, and have devised new testing methods in order to artificially reproduce this corrosive environment. Currently there is no standard test (for example to an ASTM standard such as applies to CASS testing) and therefore each automotive manufacturer has devised its own specific test. While these testing methods vary in details, they are all based on the same principle and typically involve the following steps;
(a) mixing a small amount of calcium chloride solution with kaolin to form a paste;
(b) applying a fixed amount of this paste to an area of the article under test;
(c) leaving the paste for a predetermined time in an environment of fixed temperature and, optionally, fixed humidity;
(d) removing the paste by washing with water, drying, and then assessing the appearance of the deposit;
(e) repeating steps (a) to (d) as desired.

When this type of test is applied to deposits of the present invention it is surprisingly found that they have a considerably improved corrosion resistance as compared to traditional chromium coatings obtained from hexavalent chromium electroplating baths.

The chromium deposits of the invention are typically chromium-sulfur alloys and contain some co-deposited sulfur, preferably in the form of sulfides. Again, without wishing to be bound by theory, the inventors propose that the incorporation of this co-deposited sulfur, preferably sulfides, into the deposit renders the deposit more resistant to attack in the calcium chloride environments. Typically the chromium deposits of this invention contain between about 0.5 and 25% by weight of sulfur. Preferably, the chromium deposits of this invention comprise between about 2.0% by weight and 20% by weight sulfur. The concentration of sulfur in the deposit can be adjusted by adjusting the concentration of sulfur bearing compounds in the chromium electroplating bath. Preferably, the concentration of the sulfur bearing compounds in the chromium electroplating bath is from 0.001 to 10 g/l, most preferably from 0.01 to 2.5 g/l.

Typically the chromium electroplating electrolyte comprises the following ingredients;
(a) a water soluble trivalent chromium salt;
(b) additional inert water soluble salts to improve solution conductivity;
(c) a complexant for the trivalent chromium ions;
(d) hydrogen ions to provide a pH of about 2.8-4.2;
(e) a pH buffering compound; and
(f) a sulfur-containing organic compound, preferably containing sulfur in the divalent form.

Typical examples of compounds usable in the composition of the electrolytes according to the present invention are set forth below although the current invention is not limited to deposits obtained from electrolytes containing only the listed examples. Various prior art chromium electroplating electrolytes are described generally in Great Britain Patent No. 1488381, and U.S. Pat. Nos. 4,157,945, 4,374,007, 4,448,648, 4,448,649, 4,432,843, 4,472,250 and 4,502,927, the subject matter of each of which is herein incorporated by reference in its entirety. The water soluble trivalent chromium salt is typically selected from the group consisting of chromium sulfate, chromium chloride, chromium methane sulfonate, and combinations of one or more of the foregoing. Other similar water-soluble trivalent chromium salts are also usable in the practice of the invention. The concentration of the water-soluble trivalent chromium salt in the chromium electroplating electrolyte is preferably in the range of about 15 to about 125 grams per liter, more preferably in the range of about 25 to about 80 grams per liter. Preferably the concentration of chromium ions in the plating bath is from 5 to 20 g/l.

The additional inert water-soluble salt is typically one or more water-soluble salts of chloride or sulfate, including for example, the chloride or sulfate salts of sodium, potassium and ammonium. In a preferred embodiment, the additional inert water-soluble salts comprise one or more of sodium sulfate, potassium sulfate, and ammonium sulfate, at a total concentration of between about 100 and 300 grams per liter in the chromium electroplating electrolyte.

The source of hydrogen ions is preferably selected from the group consisting of sulfuric acid, acetic acid, hydrochloric acid, phosphoric acid or other phosphoric containing acidic species, and combinations of one or more of the foregoing. The hydrogen ion concentration in the chromium plating bath should be sufficient to achieve a pH of about 2.8-4.2.

The pH buffering compound is used to maintain the pH of the electrolyte at the desired level and is typically selected from the group consisting of boric acid and salts thereof, acetic acid and salts thereof, phosphoric acid and salts thereof, glycine and salts thereof and combinations of one or more of the foregoing. The concentration of the pH buffering compound in the electrolyte solution is dependent on the desired pH of the electrolyte and is typically in the range of about 50 to about 100 grams per liter. As noted the pH of the plating bath should be in the range of about 2.8-4.2.

The source of the co-deposited sulfur, preferably sulfide, contained in the deposits of the invention is the sulfur-containing organic compounds in the electrolyte formulation. The sulfur-containing organic compound is preferably selected from the group consisting of sodium thiocyanate and other salts thereof sodium dimethyldithiocarbamate, other soluble dialkyldithiocarbamate salts, thiourea and derivatives thereof including, for example allylthiourea, sodium mercaptopropane sulfonate, other soluble mercaptoalkanesulfonate salts, and combinations of one or more of the foregoing. As discussed above, the sulfur-containing organic compound preferably contains sulfur in the divalent form such that the chromium deposit of the invention is a chromium sulfur alloy containing co-deposited sulfur in the form of sulfides. The sulfur-containing organic compound is typically present in the chromium electroplating electrolyte at a concentration capable of producing a concentration in the range of about 0.5 and 25% by weight of sulfur in the chromium deposit. Typically, the higher the concentration of the sulfur bearing organic compound in the plating bath, the higher the concentration of sulfur in the plated deposit. Preferably the concentration of the sulfur bearing organic compound in the electroplating electrolyte is from 0.001 to 10 g/l, most preferably from 0.01 to 2.5 g/l.

The complexant for trivalent chromium ions is typically selected from dicarboxylic acids and suitable salts thereof and aminocarboxylic acids and suitable salts thereof. Examples of these dicarboxylic acids and aminocarboxylic acids include one or more of malic acid, aspartic acid, maleic acid, succinic acid and glycine by way of example and not limitation. The concentration of the one or more complexants in the chromium plating bath is preferably in the range of about 5 to about 40 grams per liter, more preferably in the range of about 10 to 25 grams per liter.

In addition, although not required to produce deposits in accordance with the present invention, other organic compounds may also optionally be added to improve the aesthetic appearance of the deposit and to lower the surface tension of the electrolyte. Typically these compounds include saccharin, sodium allyl sulfonate, 2-butyne-1,4-diol, sodium 2-ethylhexyl sulfate, sodium dihexyl sulfosuccinate and other water-soluble salts of such compounds, by way of example and not limitation.

EXAMPLES

The usefulness of the invention is demonstrated by the following non-limiting examples.

In each of the examples, the thickness of the chromium coating is determined by coulometric thickness testing.

The oxidation state of the sulfur in the deposits of examples 1, 4 and 6 was determined by X-Ray Photoelectron Spectroscopy (XPS).

Auger Electron Spectroscopy (AES) was used to determine the composition of the deposit from Examples 1 through 5 and Comparative Example 6. The composition figure quoted is taken from the bulk film to avoid the effects of surface oxidation on compositional analysis.

The corrosion resistance of the deposits to a calcium chloride environment is determined as follows;

(a) 5 ml of a saturated solution of calcium chloride at 40° C. was mixed with 3 g of kaolin to form a paste.

(b) 80-100 mg of the prepared paste was applied to the test panel, spread over a circular test area of 15 mm diameter.

(c) The test panel was placed in an oven at 60° C. for 48 hours.

(d) After 48 hours the panels were removed, the dried paste was washed off and the deposit appearance assessed for corrosion.

This test represents a typical calcium chloride test used by a large automotive manufacturer.

Each test panel was tested in 3 different test areas and the paste was freshly prepared for each test. The test panels were allowed to stand for 14 days after plating before being tested.

Example 1

A trivalent chromium electroplating solution was prepared as follows;

| | |
|---|---|
| Basic chromium sulfate | 65 g/l |
| Malic acid | 15 g/l |
| Sodium sulfate | 35 g/l |
| Ammonium sulfate | 30 g/l |
| Potassium sulfate | 140 g/l |
| Boric acid | 90 g/l |
| Sodium saccharin dehydrate | 2.5 g/l |
| Thiourea | 10 mg/l |
| Sodium dihexylsulfosuccinate | 250 mg/l |

Prior to adding the sodium saccharin dihydrate, thiourea and sodium dihexylsulfosuccinate, the solution was purified by treatment with 1 ml/l of 35% hydrogen peroxide and 1 g/l of activated carbon, filtered and the pH adjusted to 3.3-3.5. A steel panel was electroplated with three layers of nickel according to ASTM B456 (semi-bright, bright and microporous nickel) and coated with approximately 0.3 μm chromium from the solution of example 1 by immersing the steel panel as a cathode in the solution of example 1 and passing a current through the solution at a current density of 10 $A/dm^2$ for 12 minutes to deposit a chromium alloy on the steel panel. The electrolyte temperature was 60° C. and a mixed metal oxide ($IrO_2/Ta_2O_3$) anode was used.

Example 2

A trivalent chromium electroplating solution was prepared as follows;

| | |
|---|---|
| Basic chromium sulfate | 40 g/l |
| Malic acid | 9.0 g/l |
| Aspartic acid | 1.0 g/l |
| Sodium sulfate | 180 g/l |
| Boric acid | 80 g/l |
| Sodium saccharin dehydrate | 2.0 g/l |
| Thiourea | 10 mg/l |
| Sodium dihexylsulfosuccinate | 250 mg/l |

Prior to adding the sodium saccharin dihydrate, thiourea and sodium dihexylsulfosuccinate, the solution was purified by treatment with 1 ml/l of 35% hydrogen peroxide and 1 g/l of activated carbon, filtered and the pH adjusted to 3.3-3.5. A steel panel was electroplated with three layers of nickel according to ASTM B456 (semi-bright, bright and microporous nickel) and coated with approximately 0.3 μm chromium from the solution of example 2 by immersing the steel panel as a cathode in the solution of example 2 and passing a current through the solution at a current density of 10 $A/dm^2$ for 12 minutes to deposit a chromium alloy on the steel panel. The electrolyte temperature was 60° C. and a mixed metal oxide ($IrO_2/Ta_2O_3$) anode was used.

Example 3

A trivalent chromium electroplating solution was prepared as follows;

| | |
|---|---|
| Basic chromium sulfate | 35 g/l |
| Malic acid | 8.5 g/l |
| Sodium sulfate | 45 g/l |
| Potassium sulfate | 140 g/l |
| Boric acid | 90 g/l |
| Sodium saccharin dehydrate | 3.0 g/l |
| Thiourea | 15 mg/l |
| Sodium dihexylsulfosuccinate | 250 mg/l |

Prior to adding the sodium saccharin dihydrate, thiourea and sodium dihexylsulfosuccinate, the solution was purified by treatment with 1 ml/l of 35% hydrogen peroxide and 1 g/l of activated carbon, filtered and the pH adjusted to 3.3-3.5. A steel panel was electroplated with three layers of nickel according to ASTM B456 (semi-bright, bright and microporous nickel) and coated with approximately 0.3 μm chromium from the solution of example 3 by immersing the steel panel as a cathode in the solution of example 3 and passing a current through the solution at a current density of 10 $A/dm^2$ for 10 minutes to deposit a chromium alloy on the steel panel. The electrolyte temperature was 60° C. and a mixed metal oxide ($IrO_2/Ta_2O_3$) anode was used.

Example 4

A trivalent chromium electroplating solution was prepared as follows;

| | |
|---|---|
| Basic chromium sulfate | 40 g/l |
| Malic acid | 9.0 g/l |
| Aspartic acid | 15 g/l |
| Sodium sulfate | 50 g/l |
| Potassium sulfate | 140 g/l |

-continued

| | |
|---|---|
| Boric acid | 55 g/l |
| Sodium saccharin dehydrate | 3.0 g/l |
| Sodium thiocyanate | 1.0 g/l |
| Sodium dihexylsulfosuccinate | 150 mg/l |

Prior to adding the sodium saccharin dihydrate, sodium thiocyanate and sodium dihexylsulfosuccinate, the solution was purified by treatment with 1 ml/l of 35% hydrogen peroxide and 1 g/l of activated carbon, filtered and the pH adjusted to 3.3-3.5. A steel panel was electroplated with three layers of nickel according to ASTM B456 (semi-bright, bright and microporous nickel) and coated with approximately 0.3 μm chromium from the solution of example 4 by immersing the steel panel as a cathode in the solution of example 4 and passing a current through the solution at a current density of 10 $A/dm^2$ for 5 minutes to deposit a chromium alloy on the steel panel. The electrolyte temperature was 60° C. and a mixed metal oxide ($IrO_2/Ta_2O_3$) anode was used.

Example 5

A trivalent chromium electroplating solution was prepared as follows;

| | |
|---|---|
| Basic chromium sulfate | 60 g/l |
| Malic acid | 12 g/l |
| Aspartic acid | 1.0 g/l |
| Sodium sulfate | 35 g/l |
| Ammonium sulfate | 30 g/l |
| Potassium sulfate | 140 g/l |
| Boric acid | 90 g/l |
| Sodium saccharin dehydrate | 2.0 g/l |
| Thiourea | 10 mg/l |
| Sodium thiocyanate | 750 mg/l |
| Sodium dihexylsulfosuccinate | 200 mg/l |

Prior to adding the sodium saccharin dihydrate, thiourea, sodium thiocyanate and sodium dihexylsulfosuccinate, the solution was purified by treatment with 1 ml/l of 35% hydrogen peroxide and 1 g/l of activated carbon, filtered and the pH adjusted to 3.3-3.5. A steel panel was electroplated with three layers of nickel according to ASTM B456 (semi-bright, bright and microporous nickel) and coated with approximately 0.3 μm chromium from the solution of example 5 by immersing the steel panel as a cathode in the solution of example 5 and passing a current through the solution at a current density of 10 $A/dm^2$ for 12 minutes to deposit a chromium alloy on the steel panel. The electrolyte temperature was 60° C. and a mixed metal oxide ($IrO_2/Ta_2O_3$) anode was used.

Comparative Example 6

A chromium electroplating solution was created as follows;

| | |
|---|---|
| Chromium trioxide | 225 g/l |
| Sulfuric acid | 1.0 g/l |
| Sodium hexafluorosilicate | 1.0 g/l |

This solution represents a typical decorative chromium electroplating solution containing hexavalent chromium.

A steel panel was electroplated with three layers of nickel according to ASTM B456 (semi-bright, bright and microporous nickel) and coated with approximately 0.3 μm chromium from the described solution by immersing the steel panel as a cathode in the solution of example 5 and passing a current through the solution at a current density of 10 $A/dm^2$ for 4 minutes to deposit a chromium alloy on the steel panel.

The results from the examples are summarized below in Tables 1-4:

TABLE 1

Thickness Data

| | Deposit thickness (μm) |
|---|---|
| Example 1 | 0.23 |
| Example 2 | 0.26 |
| Example 3 | 0.22 |
| Example 4 | 0.36 |
| Example 5 | 0.41 |
| Comparative Example 6 | 0.32 |

TABLE 2

XPS Data

| | Peak energy (eV) | Peak Assignment | Relative Area (%) |
|---|---|---|---|
| Example 3 | 162.1 | sulfide | 74 |
| | 169.5 | sulfate | 26 |
| Example 5 | 162.2 | sulfide | 92 |
| | 169.0 | sulfate | 8 |
| Comparative Example 6 | No sulfur peak detected | | |

TABLE 3

AES Compositional Analysis in % w/w

| | Depth (nm) | Cr | S | C | O | N |
|---|---|---|---|---|---|---|
| Example 1 | 50 | 87.7 | 4.8 | 3.7 | 1.3 | 2.5 |
| Example 2 | 100 | 91.7 | 2.0 | 1.9 | 2.0 | 2.4 |
| Example 3 | 100 | 89.1 | 4.0 | 2.7 | 2.0 | 2.2 |
| Example 4 | 50 | 65.1 | 16.7 | 7.6 | 7.9 | 3.0 |
| Example 5 | 50 | 66.4 | 22.0 | 9.2 | 1.2 | 1.2 |
| Comparative Example 6 | 50 | 96.5 | 0.0 | 0.0 | 0.7 | 2.8 |

Tables 2 and 3 demonstrate the presence of sulfur in the deposits of the invention and that it is generally in the form of sulfur(ii), and that sulfur is absent from the deposit of the prior art obtained from a hexavalent electroplating bath.

TABLE 4

Corrosion Resistance of the Examples

| | Degree of corrosion | | |
|---|---|---|---|
| Example 1 | 2 | 1 | 2 |
| Example 2 | 2 | 2 | 2 |
| Example 3 | 3 | 2 | 2 |
| Example 4 | 1 | 1 | 1 |

TABLE 4-continued

Corrosion Resistance of the Examples

| | Degree of corrosion | | |
|---|---|---|---|
| Example 5 | 1 | 1 | 2 |
| Comparative Example 6 | 3 | 4 | 3 |

The test panels are examined by viewing under indoor fluorescent lighting at a distance of 30 cm and rated as follows;
1 = no visible corrosion
2 = slight discoloration
3 = moderate discoloration
4 = severe discoloration and some removal of chromium coating
5 = complete removal of chromium coating The results from the examples clearly show the improvements provided by the deposits of the invention.

Finally, while the invention has been particularly shown and described with respect to preferred embodiments thereof, it will be understood that changes in form and details may be made therein without departing from the scope and spirit of the invention.

What is claimed is:

1. A method of depositing a corrosion resistant chromium alloy coating on an article, the method comprising the steps of:

a) coating the article by electrolytic or electroless means with one or more layers of metal or metal alloy, wherein said metal or metal alloy comprises palladium, tin, copper or nickel; and thereafter b) immersing the article as a cathode in a chromium electroplating solution, wherein the chromium electroplating solution comprises:

i) a water soluble trivalent chromium salt;

ii) a complexant for trivalent chromium ions comprising at least one dicarboxylic acid or salt thereof and at least one aminocarboxylic acid or salt thereof;

iii) a pH buffering compound; and iv) a sulfur-containing organic compound comprising a divalent sulfur; and c) passing an electrical current through the chromium electroplating solution to deposit a chromium alloy on the article;

wherein the chromium electroplating solution has a pH of about 2.8-4.0.

2. The method according to claim 1, wherein the chromium electroplating solution further comprises a water-soluble salt selected from the group consisting of sodium, potassium and ammonium salts of chloride and sulfate and combinations of one or more of the foregoing.

3. The method according to claim 1, wherein the water soluble trivalent chromium salt of the chromium electroplating solution is selected from the group consisting of chromium sulfate, chromium chloride, chromium methane sulfonate, and combinations of one or more of the foregoing.

4. The method according to claim 1, wherein the chromium alloy deposit comprises from 2% by weight to 20% by weight sulfur.

5. The method according to claim 1, wherein the pH buffering compound of the chromium electroplating solution is selected from the group consisting of boric acid and salts thereof, acetic acid and salts thereof, phosphoric acid and salts thereof, glycine and salts thereof, and combinations of one or more of the foregoing.

6. The method according to claim 1, wherein the sulfur-containing organic compound of the chromium electroplating solution is selected from the group consisting of sodium thiocyanate and other salts thereof, sodium dimethyldithiocarbamate, other dialkylthiocarbamate salts, thiourea and derivatives thereof, sodium mercaptopropane sulfonate, other soluble mercaptoalkanesulfonate salts, and combinations of one or more of the foregoing.

7. The method according to claim 1, wherein the thickness of the chromium alloy deposit on the metal-coated article is between about 0.2 μm and about 1.0 μm.

8. The method according to claim 1, wherein when the article with the chromium alloy deposit thereon is exposed to a calcium chloride environment for 48 hours at a temperature of 60°, there is no visible corrosion on the chromium alloy deposit, whereby the chromium alloy deposit exhibits good corrosion protection in the calcium chloride environment.

9. The method according to claim 1, wherein the complexant for trivalent chromium ions of the chromium electroplating solution is present at a concentration in the electroplating solution from 5 g/l to 40 g/l.

10. The method according to claim 1, wherein the chromium electroplating solution further comprises at least one additive selected from the group consisting of saccharin, sodium allyl sulfonate, 2-butyne-1,4 diol, sodium 2-ethylhexyl sulfate, sodium dihexyl sulfosuccinate, and water soluble salts of the foregoing compounds.

11. The method according to claim 1, further comprising the step of cleaning the article before coating the article by electrolytic or electroless means with the one or more layers of metal or metal alloy.

12. The method according to claim 1, wherein the chromium electroplating solution is maintained at a temperature of about 60° C.

* * * * *